US006506095B1

(12) United States Patent
Lund et al.

(10) Patent No.: US 6,506,095 B1
(45) Date of Patent: Jan. 14, 2003

(54) ANIMATED TOY DOLL

(75) Inventors: Bruce D. Lund, Chicago, IL (US); Krishnan Srirangam, Chicago, IL (US); Sunil Moothedath, Chicago, IL (US); Michael Starrick, Maywood, IL (US)

(73) Assignee: Lund & Company, Chicago, IL (US)

( * ) Notice: Subject to any disclaimer, the term of this patent is extended or adjusted under 35 U.S.C. 154(b) by 0 days.

(21) Appl. No.: 10/059,784

(22) Filed: Jan. 30, 2002

(51) Int. Cl.[7] ..... A63H 11/00

(52) U.S. Cl. ..... 446/353; 446/268; 446/352; 446/330

(58) Field of Search ..... 446/268, 297, 446/298, 303, 324, 325, 330, 333, 352, 353, 354, 376, 378, 379, 397, 486

(56) References Cited

U.S. PATENT DOCUMENTS 2,596,491 A * 5/1952 Kinberg ..... 446/354
2,906,059 A * 9/1959 Berger ..... 200/61.01
3,568,362 A * 3/1971 Tomaro ..... 446/139
4,266,367 A * 5/1981 Kuna et al. ..... 446/177
4,312,150 A * 1/1982 Terzian ..... 446/354
4,349,987 A * 9/1982 Bart ..... 446/355
5,236,385 A * 8/1993 May ..... 446/300

* cited by examiner

*Primary Examiner*—Jacob K. Ackun
*Assistant Examiner*—Bena B. Miller

(57) ABSTRACT

The present invention includes a doll defined by an upper half hingedly attached to a lower half. A spring means attached to the upper and lower halves resiliently place the halves in a substantially planar position. A locking mechanism is included for retaining the halves in a substantially non-planar position, when the locking mechanism is engaged. A motor means is also attached to the upper and lower halves for moving the halves in a substantially non-planar position. When the motor means moves the upper and lower halves a predetermined distance, the locking mechanism engages and the upper and lower halves are maintained in the substantially non-planar position. The doll may be moved from a standing position into a sitting position; from a sitting position into a laying position; a laying position into a sitting position and a laying position into a laying position with the lower half angled upwardly.

20 Claims, 2 Drawing Sheets

ANIMATED TOY DOLL

BACKGROUND OF THE INVENTION

Dolls have always been the mainstay as a toy for young children. There have been numerous varieties of dolls from no interaction to fully interactive dolls. There exist dolls speak, cry, sing and laugh in response to a child touching or squeezing various parts of the doll, as well as dolls that walk and crawl. However, there are always a continual need for improvements and new and novel features.

SUMMARY OF THE INVENTION

There is herein described and illustrated a unique animated doll that is hinged at the hips or waist. The hinged hips permit the doll to sit down from a standing position, lay down from the sitting position and sit up from a laying down position. Various position detectors act in concert to detect the various positions of the doll, resulting in different play patterns or phrases.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
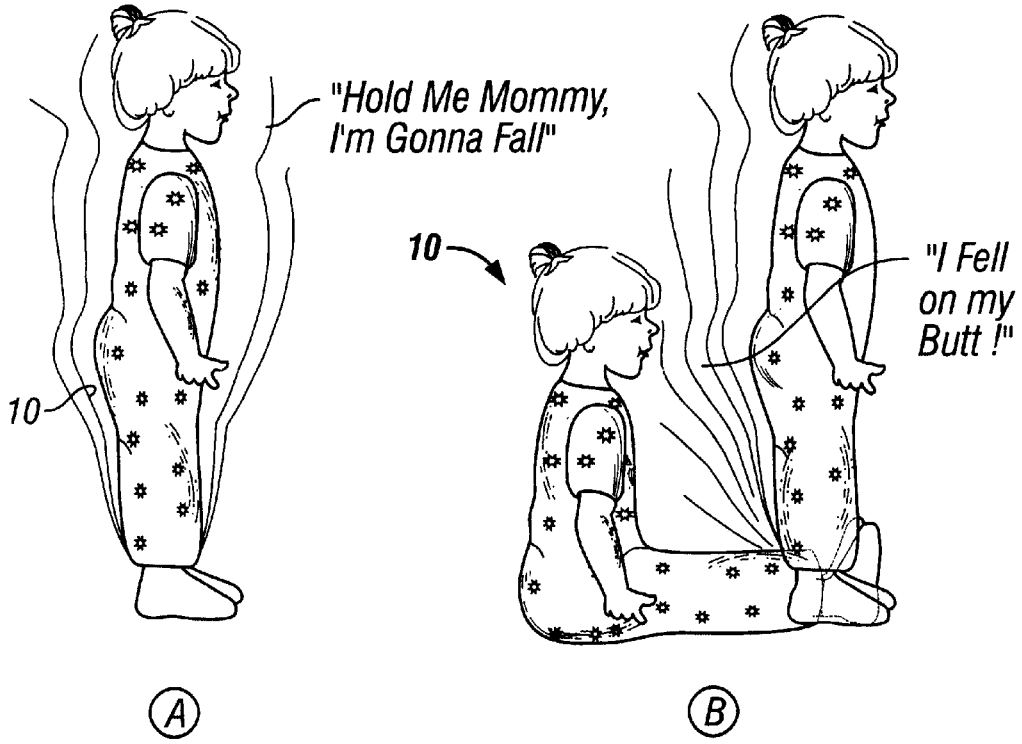
FIG. 1 is a side view of the doll showing in two illustrations the doll wobbling unsteadily (A) and moving from a standing position to a sitting position (B)

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
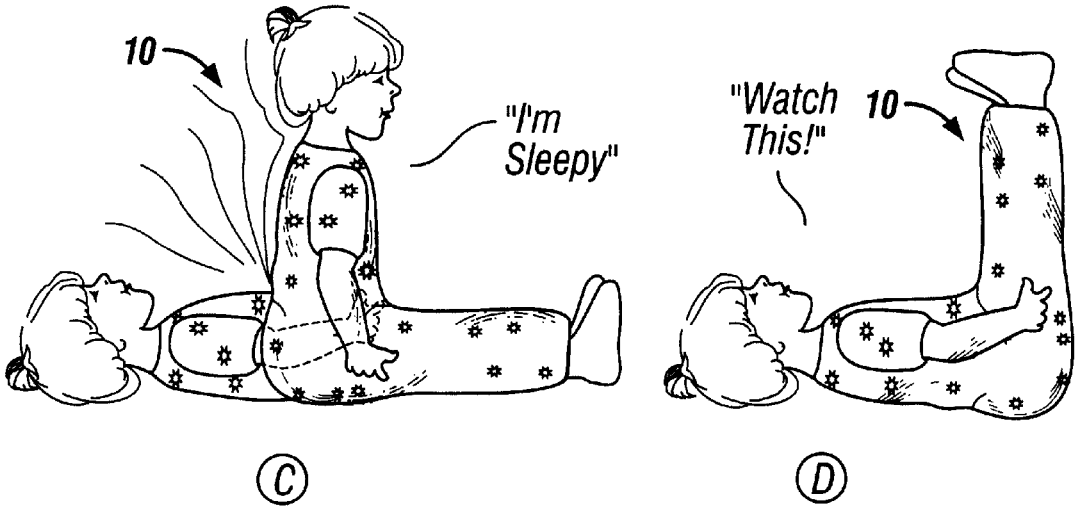
FIG. 2 is a side view of the doll showing in two illustrations the doll moving from a sitting position to a laying down position and also to a position with its legs in the air.

Referring now to FIGS. 1 and 2, a doll 10 in accordance with the present invention is illustrated in various positions. FIG. 1 shows the doll 10 wobbling unsteadily position A and moving from a standing to a sitting position B. In FIG. 2 the doll 10 moves from a sitting position to a laying position C, or can move from a laying position to a position with its legs in the air, position D, or vice versa. The doll 10 may also emit pre-programmed sounds in response to the specific movements or positions. Other movements may include moving the doll 10 from a laying position to a sitting position, as well as jiggling the legs while in a laying position.

Figure 3:
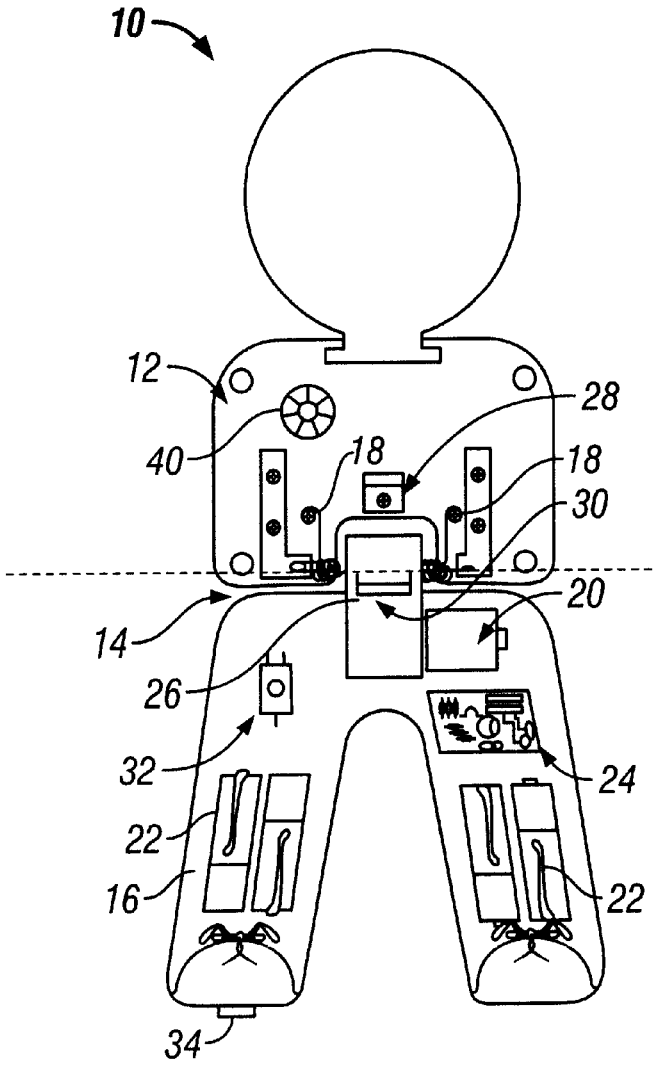
FIG. 3 is a front view of the respective components of the doll to accomplish the movements described hereinbelow.
Figure 4:
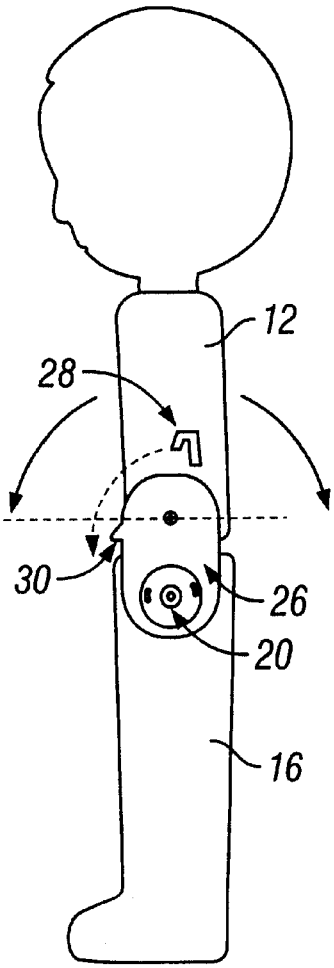
FIG. 4 is a side view of FIG. 3.

Referring now to FIG. 3 the components to achieve the movements described above are illustrated. The doll 10 includes an upper half 12 or torso hingedly attached at a mid section 14 to a gearbox 26 that is further attached to a lower half 16 or legs. The upper and lower halves may also represent the upper half of the doll body and lower half of the doll body. A pair of springs 18 are attached to the doll 10 in a manner that causes the two halves 12 and 16 to naturally oppose each other and remain in a substantially straight configuration, such as exhibited in a laying down position or a standing up position.

A motor mechanism 20 in communication with the gear box 26 acts to move the two halves 12 and 16 against the force of the springs 18, bringing the two halves 12 and 16 together, such as exhibited in a sitting position or in a position with its legs in the air. The motor 20 is powered by a power supply 22 and controlled through a circuit board 24.

In order to keep the halves 12 and 16 together without continually running the motor mechanism against the opposing force of the springs 18, a locking mechanism is employed. The locking mechanism engages when the two halves 12 and 16 are moved towards each other a sufficient distance. The locking mechanism is preferably defined by a latch 28, positioned on the upper half 12, which engages a catch 30, positioned at the mid section 14, preferably extending outwardly on the gear box 26. To disengage the locking mechanism the motor mechanism 20 moves the two halves 12 and 16 away from each other until the catch 30 disengages the latch 28.

The doll 10 is also capable of determining its current position through all switches 32, which is in communication with the circuit board 24. The circuit board 24 receiving a signal from the ball switches 32 can then determine the current position of the doll 10. The circuit board may then select or determine another position and operate and control the motor mechanism 20 in order to move the doll 10 to the other position.

The doll 10 also includes a foot switch 34, which when activated by a user causes the doll 10 to jiggle, to simulate the movement associated with laughter. The jiggling movement is created by rapidly controlling the motor mechanism 20 to move the two halves 12 and 16 towards each other and away from each other a short distance, such that the locking mechanism will not engage. The doll 10 may also include a speaker that will emit pre-programmed sounds in accordance with the current position of the doll 10 or with the movement of the doll 10.

During operation, a user may activate the doll 10 by an on/off switch (not shown). Once the doll 10 is turned on, the ball switches 32 sends a signal to the circuit board 24, which can then determine the position of the doll 10. If the doll is standing, the circuit board may control the motor mechanism 20 to move the two halves 12 and 16 such that the doll 10 begins to wobble and falls down into a sitting position. As mentioned above, the doll 10 will remain in the sitting position, once the locking mechanism engages. Once in the sitting position, the circuit board 24 will receive another signal from the ball switches 32. From the sitting position, the circuit board 24 may continue to control the motor mechanism 20 to move the two halves 12 and 16 such that the locking mechanism disengages and the doll 10 lays down. The user may then press the foot switch 34 in order to make the doll 10 jiggle.

From the laying down position, the doll 10 may then sit up or move its legs in the air. To move the legs, the doll 10 first sits up from a laying-down position. The doll always sits up from a laying down position when the motor mechanism is turned on, because the lower half 16 is heaver than the upper half 12. After the doll has sat up, the motor mechanism turns in the other direction. As soon as latch 28 disengages and the upper half 12 starts falling back, the motor is quickly reversed so that the lower half 16 now follows the momentum of the upper half 12. The doll 10 will then fall on its back, with her feet up in the air.

The specific type of movements are controlled by the circuit board 24 operating the motor mechanism at various rates and speeds, as well as using the opposing spring force to the doll 10 in a substantially straight or planar position.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A doll comprising:

a torso hingedly attached to a pair of legs;

a spring means attached to the torso for exerting a spring force that keeps the torso and legs in a substantially planar position; and a motor mechanism attached to the legs for moving the torso and legs towards each other against the spring means.

2. The doll of claim 1 further comprising:

a locking mechanism that engages the torso and legs, when the motor mechanism has moved the torso and legs towards each other a predetermined distance, whereby when the locking mechanism is engaged the spring force is incapable of moving the torso and legs back to the substantially planar position.

3. The doll of claim 2 wherein the motor mechanism is operated in the reverse direction to disengage the locking mechanism permitting the spring force to return the torso and legs back to the substantially planar position.

4. The doll of claim 2 further comprising a means for determining the position of the doll.

5. The doll of claim 4 further comprising a switch that when activated causes the motor mechanism to move the legs towards and away from the torso a predetermined distance such that the locking mechanism does not engage.

6. A doll having at least a torso and a lower body and further comprising:

a means for hingedly attaching the torso to the lower body;

a spring means for resiliently keeping the torso and the lower body in a substantially planar position;

a means for determining a first position of the doll; and a means for moving the torso and the lower body such that the doll is moved into a second position based upon the first position.

7. The doll of claim 6, wherein the first position is a standing position and the second position is a sitting position.

8. The doll of claim 6, wherein the first position is a sitting position and the second position is a lying prone position.

9. The doll of claim 6, wherein the first position is a lying prone position and the second position is a sitting position.

10. The doll of claim 6, wherein the first position is a lying prone position and the second position is a lying position with the lower body angled substantially upwards.

11. The doll of claim 6 further comprising a switch position on the lower body that when activated causes the moving means to jiggle the lower body.

12. The doll of claim 6 further comprising a means for locking the torso and lower body together when the moving means moves the torso and lower body towards each other a predetermined distance.

13. A doll comprising:

an upper half hingedly attached to a lower half;

a spring means attached to the upper half for resiliently placing the upper and lower halves in a substantially planar position;

a locking mechanism for retaining the upper and lower halves in a substantially non-planar position, the locking mechanism engages when said upper and lower halves are moved towards each other in a substantially non-planar direction a predetermined distance; and a motor means attached to the lower half for moving the upper and lower halves in a substantially non-planar position, whereby when said motor means moves said upper and lower halves the predetermined distance, the locking mechanism engages the upper and lower halves maintaining the upper and lower halves in the substantially non-planar position.

14. The doll of claim 13, further comprising a means for determining the position of the lower half such that a circuit board in communication with the determining means and the motor means may control the motor means to move the upper and lower halves to another position.

15. The doll of claim 14, further comprising a switch in the lower half for signaling the circuit board to control the motor means such that the motor means moves the lower half a predetermined distance that will not cause the locking mechanism to engage.

16. The doll of claim 15, wherein when the determining means determines the doll to be in a standing position, the circuit board controls the motor means to move the upper and lower halves such that the locking mechanism engages and the doll is placed in a sitting position.

17. The doll of claim 15, wherein when the determining means determines the doll to be in a laying prone position, the circuit board controls the motor means to move the upper and lower halves such that the locking mechanism engages and the doll is placed in a laying position with the lower half angled substantially upwards.

18. The doll of claim 15, wherein when the determining means determines the doll to be in a laying prone position, the circuit board controls the motor means to move the upper and lower halves such that the locking mechanism engages and the doll is placed in a sitting position.

19. The doll of claim 15, wherein when the determining means determines the doll to be in a sitting position, the circuit board controls the motor means to move the upper and lower halves a sufficient distance to disengage the locking mechanisms such that the spring means will resiliently place the upper and lower halves in a substantially planar position.

20. The doll of claim 15 further comprising a speaker for emitting pre-programmed audio sounds.

* * * * *